US010612790B2

(12) United States Patent
Le

(10) Patent No.: US 10,612,790 B2
(45) Date of Patent: Apr. 7, 2020

(54) ALERT SENSING STOVE ASSEMBLY

(71) Applicant: Chanh Le, Aloha, OR (US)

(72) Inventor: Chanh Le, Aloha, OR (US)

( * ) Notice: Subject to any disclaimer, the term of this patent is extended or adjusted under 35 U.S.C. 154(b) by 156 days.

(21) Appl. No.: 15/865,323

(22) Filed: Jan. 9, 2018

(65) Prior Publication Data

US 2019/0212012 A1 Jul. 11, 2019

(51) Int. Cl.

| | |
|---|---|
| ***F24C 3/12*** | (2006.01) |
| ***G08B 21/16*** | (2006.01) |
| ***G08B 17/06*** | (2006.01) |
| ***G08B 25/10*** | (2006.01) |
| ***F23N 5/24*** | (2006.01) |

(52) U.S. Cl.

CPC ..... *F24C 3/124* (2013.01); *F23N 5/242* (2013.01); *G08B 17/06* (2013.01); *G08B 21/16* (2013.01); *G08B 25/10* (2013.01); *F23N 2023/08* (2013.01); *F23N 2025/08* (2013.01); *F23N 2031/06* (2013.01); *F23N 2031/20* (2013.01); *F23N 2041/08* (2013.01)

(58) Field of Classification Search

CPC ..... F24C 3/122; F24C 3/124

See application file for complete search history.

(56) References Cited

U.S. PATENT DOCUMENTS

| | | | | |
|---|---|---|---|---|
| D147,940 | S | 11/1947 | Zeller | |
| 6,809,295 | B1 * | 10/2004 | Vargas | F24C 7/082 219/209 |
| 7,327,246 | B2 | 2/2008 | Schoor | |
| 8,461,492 | B1 | 6/2013 | Briones, Jr. | |
| 8,810,377 | B2 | 8/2014 | Bergmeier et al. | |
| 9,194,591 | B2 * | 11/2015 | Heit | G06K 7/00 |
| 9,980,604 | B2 * | 5/2018 | Stilo | F16K 37/0025 |
| 2010/0182136 | A1 | 7/2010 | Pryor | |
| 2013/0092032 | A1 | 4/2013 | Cafferty et al. | |
| 2015/0167987 | A1 | 6/2015 | Peterson | |
| 2019/0203942 | A1 * | 7/2019 | Green | F24C 3/124 |

FOREIGN PATENT DOCUMENTS

| | | |
|---|---|---|
| WO | WO2015168243 | 11/2015 |

* cited by examiner

*Primary Examiner* — Grant Moubry

*Assistant Examiner* — Aaron H Heyamoto

(57) ABSTRACT

An alert sensing stove assembly includes a stove that includes a plurality of burners. A plurality of valves is provided and each of the valves is in fluid communication with an associated one of the burners. A processor is coupled to the stove and the processor is electrically coupled to each of the valves. A sensor array is coupled to the stove to detect a variety of alert agents. The processor sends a shut down signal to each of the valves when the sensor array detects one of the alert agents. Thus, the sensor array enhances safety with respect to unattended operation of the stove. A communication unit is provided and the communication unit is coupled to the stove. The communication unit transmits an alert signal to an extrinsic communication network when the processor sends the shut off signal to alert a user to a potentially dangerous situation.

13 Claims, 3 Drawing Sheets

ALERT SENSING STOVE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to stove devices and more particularly pertains to a new stove device for PURPOSE.

BRIEF SUMMARY OF THE INVENTION

An embodiment of the disclosure meets the needs presented above by generally comprising a stove that includes a plurality of burners. A plurality of valves is provided and each of the valves is in fluid communication with an associated one of the burners. A processor is coupled to the stove and the processor is electrically coupled to each of the valves. A sensor array is coupled to the stove to detect a variety of alert agents. The processor sends a shut down signal to each of the valves when the sensor array detects one of the alert agents. Thus, the sensor array enhances safety with respect to unattended operation of the stove. A communication unit is provided and the communication unit is coupled to the stove. The communication unit transmits an alert signal to an extrinsic communication network when the processor sends the shut off signal to alert a user to a potentially dangerous situation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
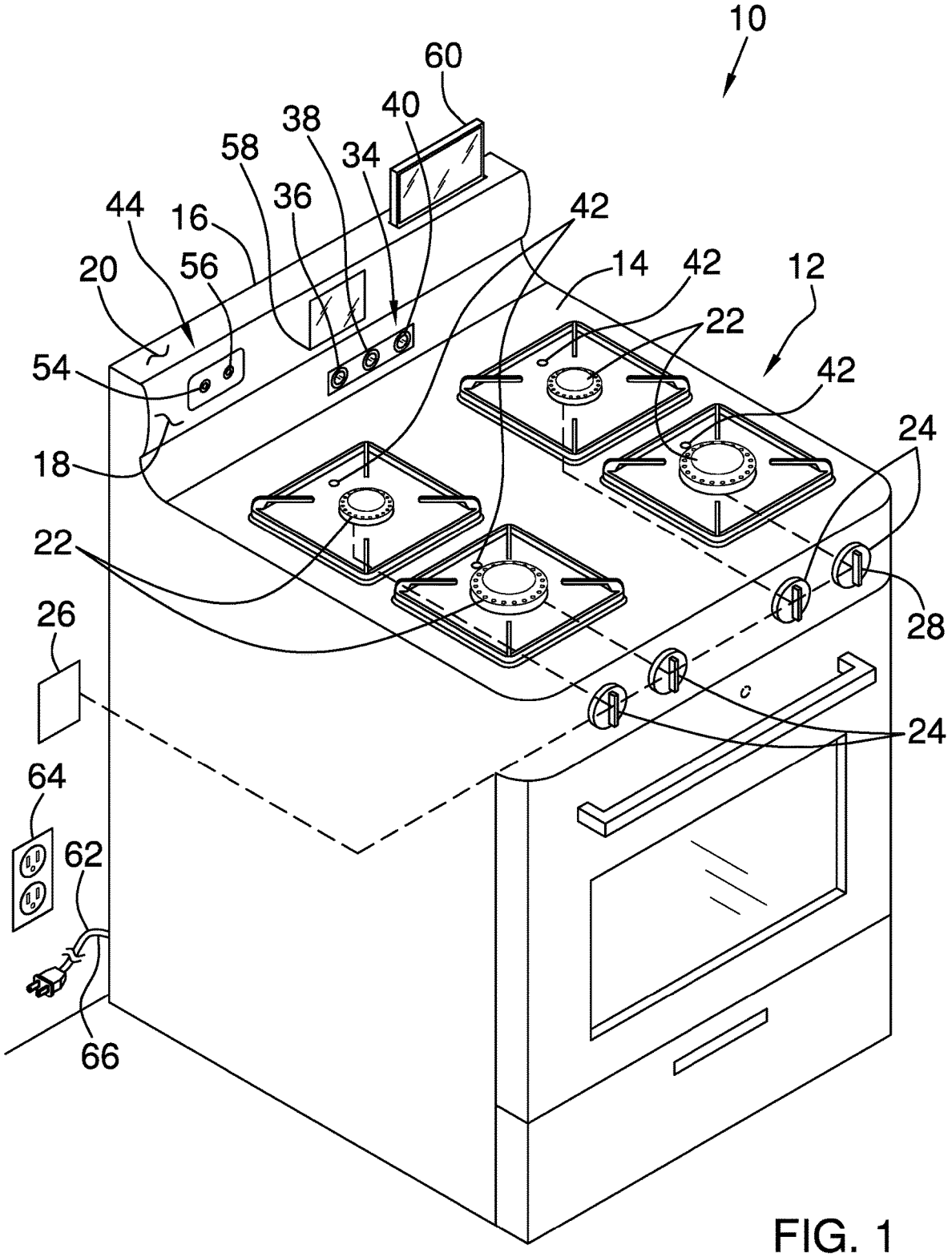
FIG. 1 is a top perspective view of an alert sensing stove assembly according to an embodiment of the disclosure.
Figure 2:
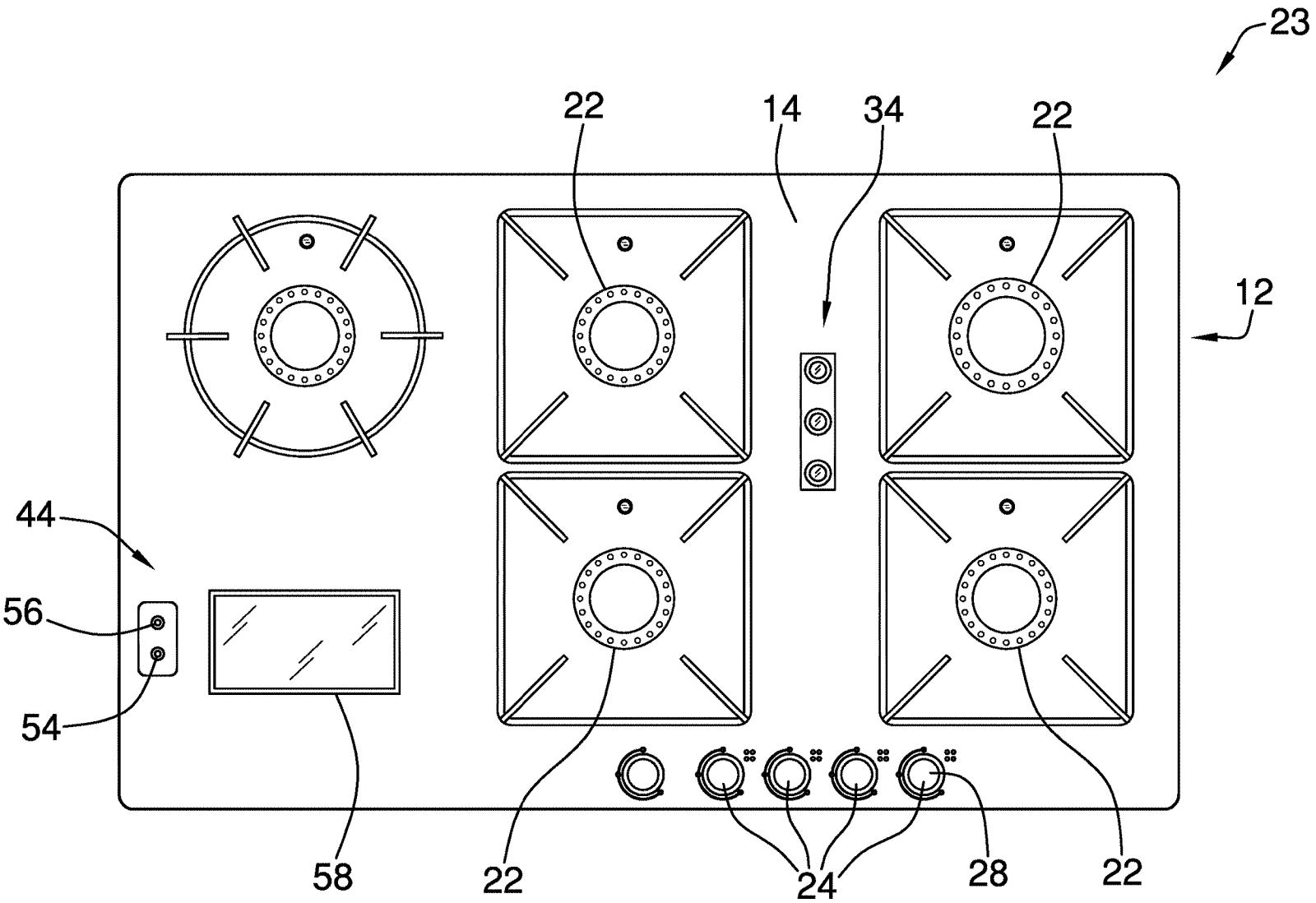
FIG. 2 is a perspective view of an alternative embodiment of the disclosure.
Figure 3:
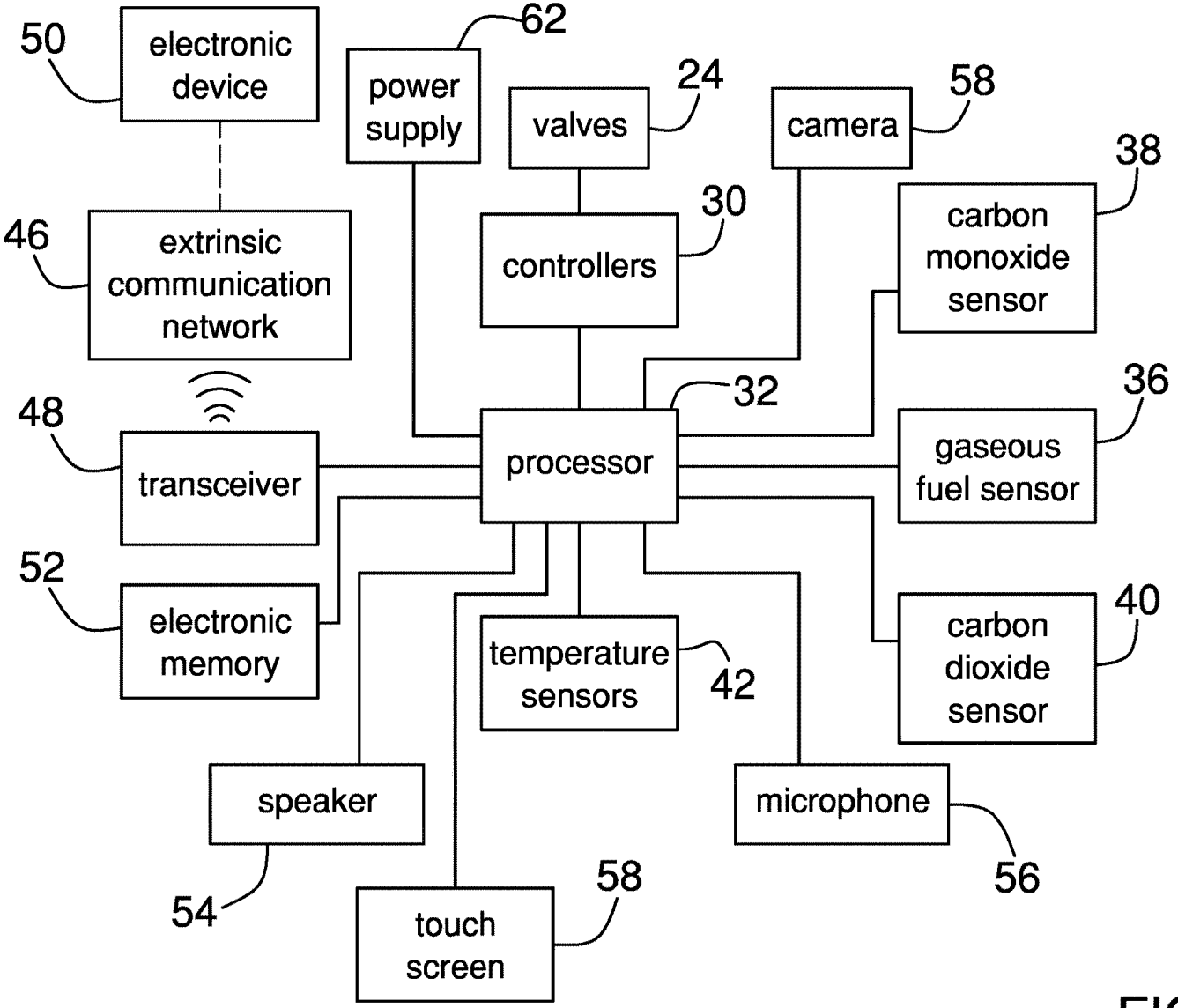
FIG. 3 is a schematic view of an embodiment of the disclosure.

With reference now to the drawings, and in particular to FIGS. 1 through 3 thereof, a new stove device embodying the principles and concepts of an embodiment of the disclosure and generally designated by the reference numeral 10 will be described.

As best illustrated in FIGS. 1 through 3, the alert sensing stove assembly 10 generally comprises a stove 12 has a top wall 14 and a console 16 extending upwardly from the top wall 14. The console 16 has a front surface 18 and a top surface 20 and the stove 12 includes a plurality of burners 22. Each of the burners 22 is positioned on the top wall 14 for cooking a food item. Moreover, each of the burners 22 may be propane burners 22, natural gas burners 22 and gaseous fuel burners of any conventional design. In an alternative embodiment 23 as shown in FIG. 2, the stove may be a cook top stove or the like.

A plurality of valves 24 is provided and each of the valves 24 is rotatably coupled to the stove 12. Each of the valves 24 is in fluid communication with an associated one of the burners 22 and each of the valves 24 is fluidly coupled to a gaseous fuel source 26. Thus, each of the valves 24 delivers a gaseous fuel to the associated burner for combustion. Each of the valves 24 may be gaseous fuel valves of any conventional design that are common to gas stoves. Additionally, each of the valves 24 includes a knob 28 that is manipulated to turn the valves 24 on and off.

A plurality of controllers 30 is includes and each of the controllers 30 is coupled to the stove 12. Each of the controllers 30 is operationally coupled to an associated one of the valves 24 and each of the controllers 30 selectively turns the associated valve 24 off. Each of the controllers 30 may be electric servos, electronic valve controllers and any other electronic means of controlling gaseous fuel valves. A processor 32 is coupled to the stove 12 and the processor 32 is electrically coupled to each of the controllers 30. The processor 32 selectively sends a shut off signal to each of the controllers 30.

A sensor array 34 is provided and the sensor array 34 is coupled to the stove 12. The sensor array 34 is in fluid communication with each of the burners 22 such that the sensor array 34 is oriented to detect a variety of alert agents. The sensor array 34 is in electrical communication with the processor 32 and the processor 32 sends the shut down signal when the sensor array 34 detects one of the alert agents. In this way the sensor array 34 enhances safety with respect to unattended operation of the stove 12.

The sensor array 34 comprises a gaseous fuel sensor 36 that is coupled to the stove 12 such that the gaseous fuel sensor 36 is in fluid communication with each of the burners 22. Moreover, the gaseous fuel sensor 36 detects un-combusted gaseous fuel and the gaseous fuel sensor 36 is electrically coupled to the processor 32. The processor 32 sends the shut off signal to each of the controllers 30 when the gaseous fuel sensor 36 senses the un-combusted gaseous fuel in concentrations greater than the Lower Explosive Limit for the gaseous fuel. The gaseous fuel sensor 36 may be an electronic gaseous fuel sensor 36 of any conventional design that is capable of detecting a concentration of ambient gaseous fuel that poses a risk of ignition.

A carbon monoxide sensor 38 is coupled to the stove 12 such that the carbon monoxide sensor 38 is in fluid communication with each of the burners 22. The carbon monoxide sensor 38 detects carbon monoxide and the carbon monoxide sensor 38 is electrically coupled to the processor 32. The processor 32 sends the shut off signal to each of the controllers 30 when the carbon monoxide sensor 38 senses carbon monoxide. Additionally, the carbon monoxide sensor 38 may be an electronic carbon monoxide sensor 38 of any conventional design.

A carbon dioxide sensor 40 is coupled to the stove 12 such that the carbon dioxide sensor 40 is in fluid communication with each of the burners 22. The carbon dioxide sensor 40 detects carbon dioxide and the carbon dioxide sensor 40 is electrically coupled the processor 32. The processor 32 sends the shut off signal to each of the controllers 30 when the carbon dioxide sensor 40 senses a trigger concentration of carbon dioxide. The trigger concentration of carbon dioxide may be approximately 5000 ppm in ambient air. Additionally, the carbon dioxide sensor 40 may be an electronic carbon dioxide sensor of any conventional design.

A plurality of temperature sensors 42 is provided and each of the temperature sensors 42 is coupled to the top wall 14 of the stove 12. Each of the temperature sensors 42 is aligned with an associated one of the burners 22 to detect a temperature of the associated burner when the associated burner is turned on. Each of the temperature sensors 42 is electrically coupled to the processor 32. The processor 32 sends the alert signal to each of the controllers 30 when one of the temperature sensors 42 detects a temperature of the associated burner that exceeds a trigger temperature. The trigger temperature may be a temperature that exceeds 400.0 degrees Fahrenheit such that each of the temperature sensors 42 senses when a pot or a pan on the stove 12 has caught on fire. In this way the temperature sensors 42 inhibit a fire from starting as a result of an un-attended stove 12. Additionally, each of the temperature sensors 42 may be electronic temperature sensors 42 of any conventional design, to include but not be limited to, infra-red heat sensors and electronic thermostats.

A communication unit 44 is coupled to the stove 12 and the communication unit 44 is in electrical communication with an extrinsic communication network 46. The extrinsic communication network 46 may be the internet or the like and the communication unit 44 is electrically coupled the processor 32. The communication unit 44 transmits an alert signal to the extrinsic communication network 46 when the processor 32 sends the shut off signal to the controllers 30.

The communication unit 44 comprises a transceiver 48 that is coupled to the stove 12. The transceiver 48 is electrically coupled the processor 32 and the transceiver 48 is in electrical communication with the extrinsic communication network 46. The transceiver 48 transmits the alert signal when the processor 32 sends the shut off signal to the controllers 30. Moreover, the transceiver 48 may be a radio frequency transceiver 48 or the like that employs a WPAN signal and Bluetooth communication protocols.

The transceiver 48 may additionally be in wireless communication with a Wi-Fi portal or the like and a user may have an electronic device 50, such as a smart phone or the like, that is in electrical communication with the extrinsic communication network 46. The transceiver 48 may be synched with the electronic device 50 via Bluetooth to facilitate two way communications between the transceiver 48 and the electronic device 50. Thus, the transceiver 48 may alert the user of a potentially dangerous situation when the user is not attending the stove 12. Additionally, the transceiver 48 facilitates each of the controllers 30 to be remotely controlled via the extrinsic communication network 46 and via Bluetooth communication.

An electronic memory 52 is coupled the stove 12 and the electronic memory 52 stores data comprising verbal statements. The verbal statements may be verbal alerts stating carbon monoxide has been detected, that carbon dioxide has been detected, that un-combusted fuel has been detected and the excessive heat has been detected. The electronic memory 52 is electrically coupled the processor 32 and the electronic memory 52 may comprise ROM memory or other means of digital data storage.

A speaker 54 is coupled to the stove 12 and the speaker 54 selectively emits an audible alert outwardly therefrom. The speaker 54 is electrically coupled to the processor 32 such that the speaker 54 receives the verbal statements from the electronic memory 52 when the processor 32 sends the shut off signal to the controllers 30. Thus, the speaker 54 audibly alerts the user of a potentially dangerous situation when the user is attending the stove 12.

A microphone 56 is coupled to the stove 12 and the microphone 56 detects audible commands spoken by the user. The microphone 56 is electrically coupled the processor 32 such that the processor 32 responds to the audible commands. Additionally, the microphone 56 may be an electronic microphone 56 or the like. A camera 58 is coupled to the stove 12 to capture images proximate the stove 12. The camera 58 is electrically coupled to the processor 32 and the transceiver 48 communicates the images to the extrinsic communication network 46. In this way the user may remotely monitor the stove 12 on the electronic device 50 via the extrinsic communication network 46 and via Bluetooth.

A touch screen 60 is provided and the touch screen 60 is movably coupled to the console 16. The touch screen 60 is electrically coupled to the processor 32. The touch screen 60 is selectively positioned in a deployed position having the touch screen 60 extending upwardly from the console 16. Thus, the touch screen 60 may be manipulated to control operational parameters of the processor 32. The touch screen 60 is selectively positioned in a stored position having the touch screen 60 is retracted into the console 16. Moreover, the touch screen 60 may comprise an LED touch screen 60 or the like.

A power supply 62 is coupled to the stove 12 and the power supply 62 is electrically coupled to a power source 64, such as a female electrical outlet or the like. The power supply 62 is electrically coupled to the processor 32 and the power supply 62 comprises a cord 66 extending outwardly from the stove 12. The cord 66 may include a plug that is selectively plugged into the female electrical outlet.

In use, the burners 22 on the stove 12 are turned on for cooking, either by manually manipulating the knobs 28 or remotely with the electronic device 50. The processor 32 sends the shut off signal to each of the controllers 30 when the carbon monoxide sensor 38 senses carbon monoxide, when the carbon dioxide sensor 40 senses the trigger concentration of carbon dioxide, when the gaseous fuel sensor 36 senses un-combusted gaseous fuel and when the temperature sensors 42 detect the trigger temperature. Thus, each of the controllers 30 turns off the associated valve thereby extinguishing the burners 22. Additionally, the speaker 54 emits the audible alert and the transceiver 48 communicates the alert signal to the electronic device 50 to alert the user of the potentially dangerous situation with respect to the stove 12. Operational parameters of the stove 12 are selectively controlled with corresponding verbal commands spoken into the microphone 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An alert sensing stove assembly being configured to detect an alert agent and notify a user of a potential danger, said assembly comprising:

a stove including a plurality of burners, said stove having a top wall and a console extending upwardly from said top wall, said console having a front surface and a top surface, each of said burners being positioned on said top wall wherein each of said burners is configured to cook a food item;

a plurality of valves, each of said valves being rotatably coupled to said stove, each of said valves being in fluid communication with an associated one of said burners, each of said valves being configured to be fluidly coupled to a gaseous fuel source thereby facilitating each of said valves to deliver a gaseous fuel to said associated burner for combustion;

a processor being coupled to said stove, said processor being electrically coupled to each of said valves, said processor selectively sending a shut off signal to each of said valves;

a sensor array being coupled to said stove, said sensor array being in fluid communication with each of said burners wherein said sensor array is configured to detect a variety of alert agents, said sensor array being electrically coupled to said processor, said processor sending said shut down signal to each of said valves when said sensor array detects one of the alert agents wherein said sensor array is configured to enhance safety with respect to unattended operation of said stove;

a communication unit being coupled to said stove wherein said communication unit is configured to be in electrical communication with an extrinsic communication network, said communication unit being electrically coupled said processor, said communication unit transmitting an alert signal to the extrinsic communication network when said processor sends said shut off signal to said valves; and a touch screen being movably coupled to said console, said touch screen being selectively positioned in a deployed position having said touch screen extending upwardly from said console wherein said touch screen is configured to be manipulated to control operational parameters of said processor, said touch screen being selectively positioned in a stored position having said touch screen being retracted into said console, said touch screen being electrically coupled to said processor.

2. The assembly according to claim 1, further comprising a plurality of controllers, each of said controllers being coupled to said stove, each of said controllers being operationally coupled to an associated one of said valves, each of said controllers selectively turning said associated valve on and off, each of said controllers being electrically coupled to said processor, said processor selectively sending said shut off signal to each of said controllers.

3. The assembly according to claim 2, wherein said sensor array comprises a gaseous fuel sensor being coupled to said stove such that said gaseous fuel sensor is in fluid communication with each of said burners wherein said gaseous fuel sensor is configured to detect un-combusted gaseous fuel, said gaseous fuel sensor being electrically coupled to said processor, said processor sending said shut off signal to each of said controllers when said gaseous fuel sensor senses the un-combusted gaseous fuel.

4. The assembly according to claim 3, further comprising a carbon monoxide sensor being coupled to said stove such that said carbon monoxide sensor is in fluid communication with each of said burners wherein said carbon monoxide sensor is configured to detect carbon monoxide, said carbon monoxide sensor being electrically coupled to said processor, said processor sending said shut off signal to each of said controllers when said carbon monoxide sensor senses carbon monoxide.

5. The assembly according to claim 4, further comprising a carbon dioxide sensor being coupled to said stove such that said carbon dioxide sensor is in fluid communication with each of said burners wherein said carbon dioxide sensor is configured to detect carbon dioxide, said carbon dioxide sensor being electrically coupled said processor, said processor sending said shut off signal to each of said controllers when said carbon dioxide sensor senses carbon dioxide.

6. The assembly according to claim 5, further comprising a plurality of temperature sensors, each of said temperature sensors being coupled to said top wall of said stove, each of said temperature sensors being aligned with an associated one of said burners wherein each of said temperature sensors is configured to detect a temperature of said associated burner when said associated burner is turned on, each of said temperature sensors being electrically coupled to said processor, said processor sending said alert signal to each of said controllers when one of said temperature sensors detects a temperature of said associated burner that exceeds a trigger temperature.

7. The assembly according to claim 2, wherein said communication unit comprises a transceiver being coupled to said stove, said transceiver being electrically coupled said processor, said transceiver being configured to be in electrical communication with the extrinsic communication network, said transceiver transmitting the alert signal when said processor sends said shut off signal to said controllers wherein said transceiver is configured to alert a user of a potentially dangerous situation when the user is not attending said stove, said transceiver facilitating each of said controllers to be remotely controlled via the extrinsic communication network.

8. The assembly according to claim 7, further comprising an electronic memory being coupled said stove, said electronic memory storing data comprising verbal statements, said electronic memory being electrically coupled said processor.

9. The assembly according to claim 8, further comprising a speaker being coupled to said stove wherein said speaker is configured to emit an audible alert outwardly therefrom, said speaker being electrically coupled to said processor such that said speaker receives the verbal statements from said electronic memory wherein said processor sends said shut off signal to said controllers wherein said speaker is configured to alert the user of the potentially dangerous situation when the user is attending said stove.

10. The assembly according to claim 9, further comprising a microphone being coupled to said stove wherein said microphone is configured to detect audible commands spoken by the user, said microphone being electrically coupled said processor such that said processor responds to the audible commands.

11. The assembly according to claim 10, further comprising a camera being coupled to said stove wherein said camera is configured to capture images proximate said stove, said camera being electrically coupled to said processor wherein said transceiver is configured to communicate the images to the extrinsic communication network.

12. The assembly according to claim 1, further comprising a power supply being coupled to said stove wherein said power supply is configured to be electrically coupled to a power source, said power supply being electrically coupled to said processor, said power supply comprising a cord extending outwardly from said stove.

13. An alert sensing stove assembly being configured to detect an alert agent and notify a user of a potential danger, said assembly comprising:

a stove having a top wall and a console extending upwardly from said top wall, said console having a front surface and a top surface, said stove including a plurality of burners, each of said burners being positioned on said top wall wherein each of said burners is configured to cook a food item;

a plurality of valves, each of said valves being rotatably coupled to said stove, each of said valves being in fluid communication with an associated one of said burners, each of said valves being configured to be fluidly coupled to a gaseous fuel source thereby facilitating each of said valves to deliver a gaseous fuel to said associated burner for combustion;

a plurality of controllers, each of said controllers being coupled to said stove, each of said controllers being operationally coupled to an associated one of said valves, each of said controllers selectively turning said associated valve off;

a processor being coupled to said stove, said processor being electrically coupled to each of said controllers, said processor selectively sending a shut off signal to each of said controllers;

a sensor array being coupled to said stove, said sensor array being in fluid communication with each of said burners wherein said sensor array is configured to detect a variety of alert agents, said sensor array being electrically coupled to said processor, said processor sending said shut down signal to each of said valves when said sensor array detects one of the alert agents wherein said sensor array is configured to enhance safety with respect to unattended operation of said stove, said sensor array comprising;

a gaseous fuel sensor being coupled to said stove such that said gaseous fuel sensor is in fluid communication with each of said burners wherein said gaseous fuel sensor is configured to detect un-combusted gaseous fuel, said gaseous fuel sensor being electrically coupled to said processor, said processor sending said shut off signal to each of said controllers when said gaseous fuel sensor senses the un-combusted gaseous fuel;

a carbon monoxide sensor being coupled to said stove such that said carbon monoxide sensor is in fluid communication with each of said burners wherein said carbon monoxide sensor is configured to detect carbon monoxide, said carbon monoxide sensor being electrically coupled to said processor, said processor sending said shut off signal to each of said controllers when said carbon monoxide sensor senses carbon monoxide;

a carbon dioxide sensor being coupled to said stove such that said carbon dioxide sensor is in fluid communication with each of said burners wherein said carbon dioxide sensor is configured to detect carbon dioxide, said carbon dioxide sensor being electrically coupled said processor, said processor sending said shut off signal to each of said controllers when said carbon dioxide sensor senses carbon dioxide; and a plurality of temperature sensors, each of said temperature sensors being coupled to said top wall of said stove, each of said temperature sensors being aligned with an associated one of said burners wherein each of said temperature sensors is configured to detect a temperature of said associated burner when said associated burner is turned on, each of said temperature sensors being electrically coupled to said processor, said processor sending said alert signal to each of said controllers when one of said temperature sensors detects a temperature of said associated burner that exceeds a trigger temperature;

a communication unit being coupled to said stove wherein said communication unit is configured to be in electrical communication with an extrinsic communication network, said communication unit being electrically coupled said processor, said communication unit transmitting an alert signal to the extrinsic communication network when said processor sends said shut off signal to said controllers, said communication unit comprising:

a transceiver being coupled to said stove, said transceiver being electrically coupled said processor, said transceiver being configured to be in electrical communication with the extrinsic communication network, said transceiver transmitting the alert signal when said processor sends said shut off signal to said controllers wherein said transceiver is configured to alert a user of a potentially dangerous situation when the user is not attending said stove, said transceiver facilitating each of said controllers to be remotely controlled via the extrinsic communication network;

an electronic memory being coupled said stove, said electronic memory storing data comprising verbal statements, said electronic memory being electrically coupled said processor;

a speaker being coupled to said stove wherein said speaker is configured to emit an audible alert outwardly therefrom, said speaker being electrically coupled to said processor such that said speaker receives the verbal statements from said electronic memory wherein said processor sends said shut off signal to said controllers wherein said speaker is configured to alert the user of the potentially dangerous situation when the user is attending said stove;

a microphone being coupled to said stove wherein said microphone is configured to detect audible commands spoken by the user, said microphone being electrically coupled said processor such that said processor responds to the audible commands;

a camera being coupled to said stove wherein said camera is configured to capture images proximate said stove, said camera being electrically coupled to said processor wherein said transceiver is configured to communicate the images to the extrinsic communication network;

a touch screen being movably coupled to said console, said touch screen being selectively positioned in a deployed position having said touch screen extending upwardly from said console wherein said touch screen is configured to be manipulated to control operational parameters of said processor, said touch screen being selectively positioned in a stored position having said touch screen being retracted into said console, said touch screen being electrically coupled to said processor; and a power supply being coupled to said stove wherein said power supply is configured to be electrically coupled to a power source, said power supply being electrically coupled to said processor, said power supply comprising a cord extending outwardly from said stove.

* * * * *